US008851168B2

(12) United States Patent
Buytaert et al.

(10) Patent No.: US 8,851,168 B2
(45) Date of Patent: Oct. 7, 2014

(54) PERFORMANCE CENTRALIZER FOR CLOSE TOLERANCE APPLICATIONS

(75) Inventors: Jean Buytaert, Mineral Wells, TX (US); Ira Eugene Hining, Mineral Wells, TX (US)

(73) Assignee: Antelope Oil Tool & Mfg. Co., LLC, Mineral Wells, TX (US)

( * ) Notice: Subject to any disclaimer, the term of this patent is extended or adjusted under 35 U.S.C. 154(b) by 466 days.

(21) Appl. No.: 13/191,074

(22) Filed: Jul. 26, 2011

(65) Prior Publication Data

US 2013/0025881 A1 Jan. 31, 2013

(51) Int. Cl.
*E21B 17/10* (2006.01)
*E21B 19/24* (2006.01)

(52) U.S. Cl.
CPC ..... *E21B 17/1028* (2013.01)
USPC ..... 166/241.6

(58) Field of Classification Search
USPC ..... 166/241.1, 241.2, 241.3, 241.4, 241.6
See application file for complete search history.

(56) References Cited

U.S. PATENT DOCUMENTS

| | | | | |
|---|---|---|---|---|
| 2,841,226 | A * | 7/1958 | Conrad et al. | 166/213 |
| 3,643,739 | A * | 2/1972 | Hall, Sr. | 166/241.6 |
| 2003/0150611 | A1 * | 8/2003 | Buytaert | 166/241.6 |
| 2008/0217063 | A1 * | 9/2008 | Moore et al. | 175/57 |

* cited by examiner

*Primary Examiner* — Brad Harcourt
(74) *Attorney, Agent, or Firm* — MH2 Technology Law Group, LLP

(57) ABSTRACT

A centralizer having a plurality of collapsible bows interconnecting a first collar and a second collar, with the centralizer disposed on a tubular with a stop collar, and an attachable retainer(s) of the centralizer blocking passage of the stop collar therethrough. The bows may have a yield strength of at least about 200,000 psi. Outer surface of the bows may have a coefficient of friction equal or less than about 0.02. Maximum radial thickness of centralizer when the plurality of collapsible bows is fully collapsed may be equal to or less than 3/16". Centralizer may be rotatable relative to tubular. Centralizer having a split tubular body forming first and second collars connected by collapsible bows and a retainer to retain the split tubular body on the tubular, and the retainer, the first collar and/or the second collar providing a recess therein to receive a stop collar of the tubular.

40 Claims, 4 Drawing Sheets

PERFORMANCE CENTRALIZER FOR CLOSE TOLERANCE APPLICATIONS

BACKGROUND

Oilfield tubulars are disposed into boreholes, e.g., wellbores, to perform various tasks. In some applications, a centralizer may be disposed with, e.g., on, a tubular to laterally position the tubular within the borehole, for example, to position the tubular adjacent but spaced from the wall of the borehole (which may be in the ground itself or the inner wall of an outer tubular such as a casing, liner, etc. in the ground). A centralizer is commonly utilized to maintain separation, e.g., 360 degrees of "stand-off" from the borehole wall, between the tubular and the borehole to allow cement to be disposed in the annulus formed therebetween. Centralizing may dispose a tubular coaxial with a borehole. Centralizers may include a pair of collars that are interconnected with collapsible bows allowing passage through restrictions. Centralizers are generally retained on the tubular with the tubular extending through the respective bores of the collars and the array of bows extending radially outward from the tubular string to provide the desired stand-off. The term restriction is used generally herein to describe a reduced inside diameter portion of borehole. The restriction may be formed intentionally (e.g., an inner diameter transition) or unintentionally (e.g., dogleg, turn, sloughing, etc.).

Many wells, e.g., horizontal wells, present restrictions of very tight clearance (i.e., close tolerance) between a tubular having an external centralizer and a section of the borehole, e.g., the section where the borehole is the outer tubular of two concentric tubulars (casing strings) or where the borehole contains another restriction (e.g., a window milled into the side of the outer concentric tubular for the inner tubular to exit). For example, an inner tubular having an outer diameter of 11⅞" being run inside an outer tubular having an inner diameter of 12.3" (and an outer diameter of 13⅜") creates only 0.425" clearance on the diameter, i.e., 0.425" of positive outer diameter (OD) clearance and 0.2125" of radial thickness. Once the tubular with the centralizer disposed on it exits a "close tolerance" section (e.g., where the bows are substantially, fully collapsed), it is generally desired for the collapsed bows to elastically return to their pre-collapsed state. A failure to elastically return to their pre-collapsed state may cause the bows to not properly centralize the tubular and thus the tubular contacts the borehole wall and cement does not fully encircle the tubular to be centralized, which may lead to failure of the well.

SUMMARY

Embodiments of the disclosure may provide a centralizer to center a tubular in a borehole comprising a first collar of the centralizer comprising an inner diameter larger than an outer diameter of a stop collar of the tubular to allow passage of the stop collar therethrough and a retainer having a bore with an inner diameter smaller than the outer diameter of the stop collar to block passage of the stop collar therethrough when the retainer is attached to the first collar, a second collar of the centralizer comprising an inner diameter smaller than the outer diameter of the stop collar, and a plurality of collapsible bows connecting the first collar and the second collar.

Embodiments of the disclosure may further provide a method of assembling a centralizer for centralizing a tubular in a borehole comprising sliding a first collar of the centralizer onto the tubular and past a stop collar of the tubular, wherein the first collar comprises an inner diameter larger than an outer diameter of the stop collar of the tubular to allow passage of the stop collar therethrough, sliding a second collar of the centralizer onto the tubular, wherein the second collar comprises an inner diameter smaller than the outer diameter of the stop collar and wherein a plurality of collapsible bows connect the first collar and the second collar, and attaching a retainer to the first collar to block passage of the stop collar therethrough, the retainer having a bore with an inner diameter smaller than the outer diameter of the stop collar.

Embodiments of the disclosure may further provide a method of centralizing a tubular in a borehole with a centralizer comprising disposing the tubular comprising a stop collar into the borehole, wherein a first collar and a second collar of the centralizer are disposed on the tubular on opposing ends of the stop collar, wherein the first collar of the centralizer comprises an inner diameter larger than an outer diameter of the stop collar to allow passage of the stop collar therethrough and comprises a retainer attached to the first collar, the retainer having a bore with an inner diameter smaller than the outer diameter of the stop collar blocking passage of the stop collar therethrough, wherein a second collar of the centralizer comprises an inner diameter smaller than the outer diameter of the stop collar, and wherein a plurality of collapsible bows connect the first collar and the second collar, and pulling the centralizer into a restriction in the borehole by the stop collar contacting the first collar or the second collar and collapsing the plurality of collapsible bows.

Embodiments of the disclosure may further provide a centralizer to center a tubular in a borehole comprising a split tubular body forming a first collar and a second collar connected by a plurality of collapsible bows, a retainer attached to the split tubular body to retain the split tubular body on the tubular, and at least one of the retainer, the first collar and the second collar providing a recess therein to receive a stop collar of the tubular.

Embodiments of the disclosure may further provide a method of assembling a centralizer for centralizing a tubular in a borehole comprising disposing a split tubular body forming a first collar and a second collar connected by a plurality of collapsible bows adjacent a stop collar of the tubular, and attaching a retainer to the split tubular body to retain the split tubular body on the tubular, wherein the stop collar is received into a recess provided by at least one of the retainer, the first collar and the second collar.

Embodiments of the disclosure may further provide a method of centralizing a tubular in a borehole with a centralizer comprising disposing the tubular comprising a stop collar into the borehole, wherein the centralizer comprises a split tubular body forming a first collar and a second collar connected by a plurality of collapsible bows that is retained on the tubular by a retainer and wherein the stop collar is received into a recess provided by at least one of the retainer, the first collar and the second collar, and pulling the centralizer into a restriction in the borehole by the stop collar contacting the centralizer and collapsing the plurality of collapsible bows.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
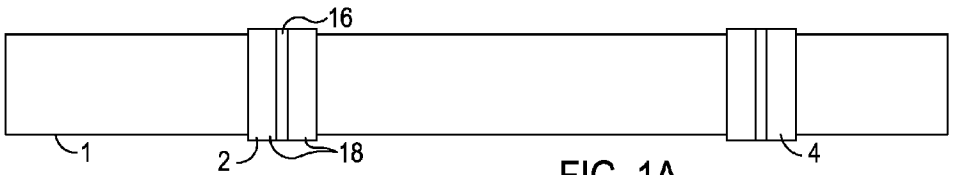
FIG. 1A illustrates a perspective view of a tubular with two stop collars attached thereto.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. The terms pipe, tubular, tubular member, casing, liner, tubing, drill pipe, drill string and other like terms can be used interchangeably. These terms may be used in combination with joint to refer to a single unitary length, a stand to refer to one or more, and typically two or three, interconnected joints, or a string to refer to two or more interconnected joints.

Figures 1B, 2B, 3B, 4B:
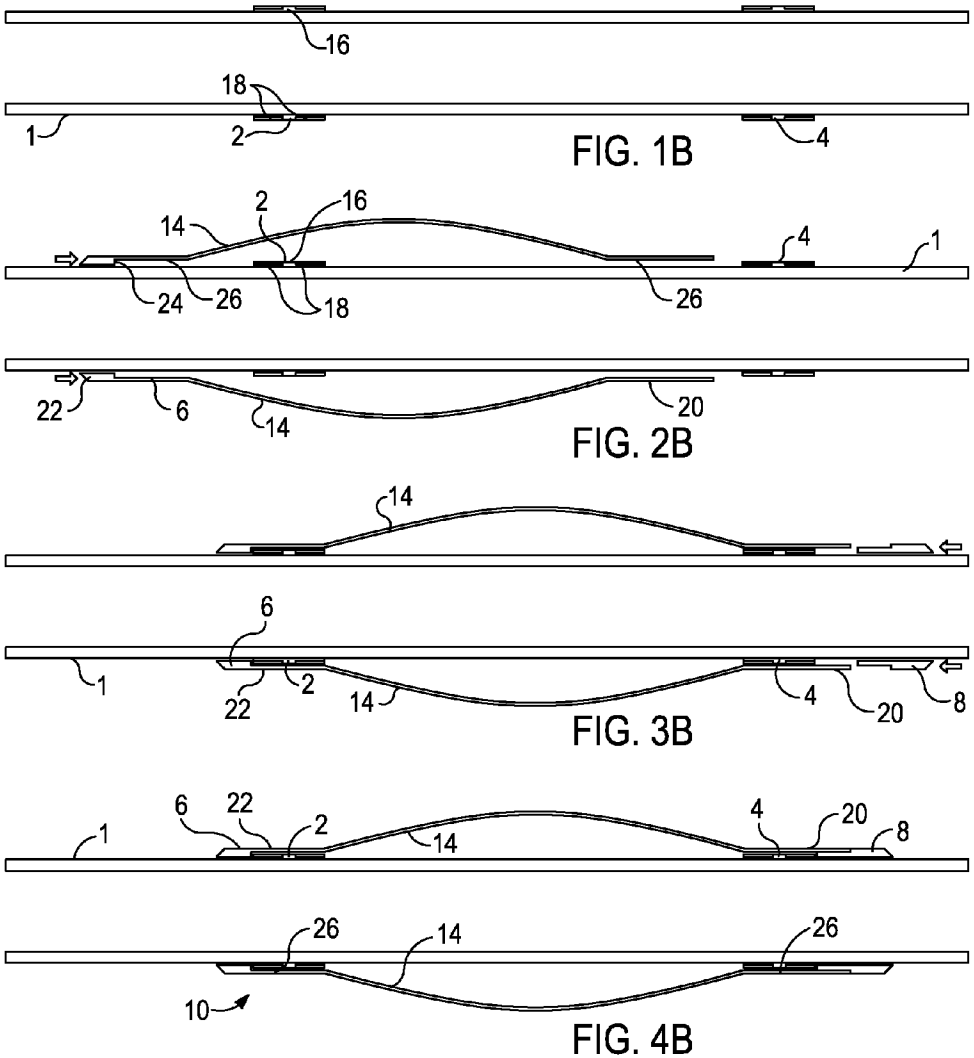
FIG. 1B illustrates a cross-section view of the tubular with two stop collars attached thereto of FIG. 1A.
FIG. 2B illustrates a cross-sectional view of the tubular body of the centralizer being disposed onto the tubular and past a first stop collar of FIG. 2A.
FIG. 3B illustrates a cross-sectional view of the tubular body of the centralizer disposed onto the tubular past first and second stop collars and the retainer being disposed onto the tubular of FIG. 3A.
FIG. 4B illustrates a cross-sectional view of the retainer attached to the tubular body to form the centralizer of FIG. 4A.

FIG. 1A illustrates a perspective view of a tubular 1 to be centralized within a borehole. Although not shown, a proximal end of tubular 1 may be attached to a lifting device, such as the drawworks of a drilling rig. Proximal end of tubular 1 may be attached to a rotary device, e.g., a rotary table (kelly) of a drilling rig or top drive of a rig that is suspended from a lifting device, such as the drawworks of a drilling rig. Lifting device and/or rotary device, e.g., components suspended from a drawworks of a rig, may be above the entry to the borehole, e.g., the surface of the earth. FIG. 1B illustrates a cross-section view of the tubular 1 with two stop collars (2, 4) attached thereto of FIG. 1A. Depicted tubular 1 (e.g., with a bore therethrough) includes two stop collars (2, 4) on an exterior surface of the tubular. Stop collars may restrict only axial movement of a centralizer. Stop collars may allow rotation of a centralizer relative to the tubular. A single stop collar may be used without departing from the spirit of this disclosure. Stop collar may be unitary with the tubular or a separate component as illustrated. Stop collar may comprise an upset of the tubular, e.g., a radially protruding shoulder of a drill pipe connector or casing connector.

A separate component type of stop collar may be secured to the tubular via clamping (e.g., set screws, nuts and/or bolts), adhesives (e.g., epoxy), welding, crimping, and/or interference fit. Depicted stop collars are interference fit (e.g., press fit) stop collars, for example as disclosed in US Patent Publication No. 2010/0326671 (filed as U.S. patent application Ser. No. 12/756,177 on Apr. 8, 2010), hereby incorporated by reference in its entirety herein. A stop collar, e.g., an interference fit stop collar, may provide a holding force equal to or greater than 10,000 pounds of force per inch of diameter of the tubular the stop collar is secured to. In one embodiment, a stop collar is compatible for use (e.g., provides a sufficient holding force and/or is non-damaging (non-marking)) with the exterior surface of the tubular, for example, if the tubular is a high grade alloy(s) which may be chosen for the required enhanced strength of a tubular (e.g., casing string).

A stop collar, e.g., an interference fit stop collar, may have a radial thickness equal or less than ⅛" (e.g., equal or less than a positive OD of ¼"). Depicted stop collars (2, 4) extend circumferentially about the periphery of tubular 1, e.g., are cylindrical. Depicted interference fit stop collars (2, 4) include a base 16 having a bore to receive the tubular 1 and a set of one or more fingers extending axially along the base 16 in a first direction and set of one or more fingers extending axially along the base 16 in a second direction and sleeves 18 having a bore receivable onto the set of fingers in an interference-fit with the fingers between the bore of the sleeves 18 and the tubular 1 to secure the stop collar to the tubular. Although a stop collar 2 with two sets of sleeves 18 and fingers is depicted, a stop collar (2, 4) may include a base 16 with one finger and one sleeve 18 without departing from the spirit of this disclosure. Depicted base 16 and sleeves 18 extend circumferentially about the periphery of tubular 1, e.g., are cylindrical. In an embodiment, a stop collar may have an axial length of about 9 inches. In an embodiment, a sleeve of a stop collar and/or a collar of a centralizer may have an axial length of about 4 inches. In an embodiment, a base of a stop collar may have an axial length of about one inch, e.g., the axial length of the base not including the finger(s) to be covered by a sleeve. In an embodiment, a stop collar and/or centralizer may be installed at a pipe yard and/or rig site. In an embodiment, stop collar(s) (e.g., interference fit stop collar) and/or centralizer may(s) be installed anywhere on the external surface of a tubular, for example, not requiring a separate tubular (sub) to be utilized.

Figure 2A:
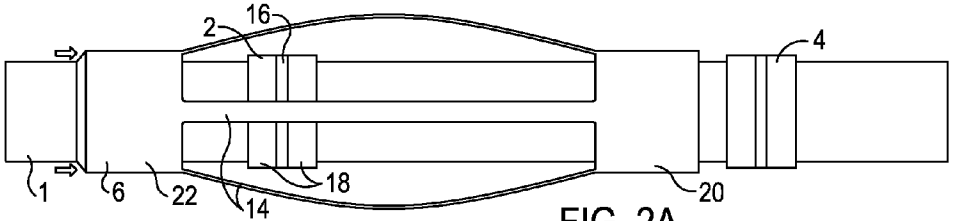
FIG. 2A illustrates a perspective view of the tubular body of a centralizer being disposed onto the tubular and past a first stop collar.

FIG. 2A illustrates a perspective view of the tubular body 6 of a centralizer being disposed onto the tubular 1 and past a first stop collar 2 on the tubular 1. Although the tubular and centralizer components are shown in a horizontal orientation in the Figures of this disclosure, they may be in a vertical orientation or any orientation therebetween. FIG. 2B illustrates a cross-sectional view of the tubular body 6 of the centralizer being disposed onto the tubular and past (e.g., over) a first stop collar of FIG. 2A. The depicted tubular body 6 of the centralizer includes a first collar 20 and a second collar 22 with a plurality of collapsible bows 14 extending therebetween. Depicted first collar 20 and second collar 22 are cylindrical. Bows 14 are collapsible to allow inward radial movement, e.g., to pass through a restriction. Three bows 14 are visible in FIG. 2A however a fourth may be included. A centralizer may include a plurality of bows, e.g., three or more bows. Bows may be spaced laterally equidistant from each other. Bows may extend parallel to the longitudinal axis of the centralizer (as shown) or they may be skewed, helical, etc. Bows may have a uniform and/or varying thickness and/or width as desired. Bows may have a thickness equal or less than ⅛" (equal or less than a positive radial protrusion of 3⁄16"), e.g., when the bows are fully collapsed along the exterior of the tubular. Bows may have a radial thickness equal or less than 1⁄16" (equal or less than a positive OD of ⅛"), e.g., when the bows are fully collapsed along the exterior of the tubular. The bow material may be selected to allow the bows to be fully collapsed (e.g., flattened) inside a close tolerance restriction without being yielded, e.g., the spring properties remain unchanged after exiting the close tolerance restriction and thus generate an optimum restoring force.

As shown more readily in FIG. 2B, first collar 20 of the tubular body 6 of the centralizer is depicted as having an inner diameter larger than an outer diameter of stop collar(s) of the tubular to allow passage of the stop collar(s) therethrough and a second collar 22 of the centralizer comprising an inner diameter smaller than the outer diameter of the stop collar. Depicted second collar 22 includes a shoulder 24 therein, e.g., to contact a stop collar to prevent axial movement past the stop collar. Shoulder 24 may extend circumferentially about the periphery of the collar bore. First collar 20 and/or second collar 22 (and/or retainer 8, as discussed below) may have a radial thickness equal or less than 1⁄16" (equal or less than a positive OD of ⅛"). First collar 20 and/or second collar 22 (and/or retainer 8, as discussed below) may have a uniform and/or varying thickness and/or width as desired. Bows 14, first collar 20 and/or second collar 22 (and/or retainer 8, as discussed below) may have a maximum radial thickness equal or less than 3⁄16" (equal or less than a positive OD of ⅜"), e.g., when the bows 14 are fully collapsed. Centralizer 10 (see FIGS. 4A and 4D) may have a maximum radial thickness equal or less than about 3⁄16" (equal or less than a positive OD of about ⅜"), e.g., when the bows 14 are fully collapsed along the exterior of the tubular 1. First collar 20 and/or second collar 22 (and/or retainer 8, as discussed below) may have a tapered leading edge, e.g., to aid in the passage through a restriction. As depicted, the minimum bore defined by the centralizer is larger than the outer diameter of the tubular.

Bows 14, first collar 20 and/or second collar 22 (and/or retainer 8, as discussed below) may be a material having a yield strength of at least about 200,000 pounds per square inch (psi). In an embodiment, a plurality of bows each has a yield strength of at least about 200,000 psi. Bows 14, first collar 20 and/or second collar 22 (and/or retainer 8, as discussed below) may be a beryllium copper alloy, for example, as currently available from the Materion Corporation. Bows 14, first collar 20 and second collar 22 may be a unitary piece, e.g., milled or forged from a single tube. In another embodiment, bows 14 are formed separately and connected to the first collar 20 and second collar 22 via weld or other fastening methods and devices. For example, first collar 20 and/or second collar 22 may be notched to accept the ends of bows that are connected (e.g., welded) in the notched pockets, e.g., such that the bow ends do not radially protrude from the collar(s) it is connected to.

Any portion of the centralizer according to this disclosure may include an outer surface having a low friction material. In an embodiment, the bows, e.g., the outer surface thereof and/or the outer surface of the bows that will contact the borehole and/or restriction when in use, may include a low friction material. In one embodiment, a low friction material has a coefficient of friction equal or less than about 0.02. One example of such a material is a ceramic alloy created from an alloy of boron, aluminum and magnesium ($AlMgB_{14}$) and titanium boride ($TiB_2$), such as is commonly referred to as BAM and available from New Tech Ceramics, Inc. In one embodiment, a low friction material has a coefficient of friction equal or less than about 0.05. One example of such a material is polytetrafluoroethylene, a fluoropolymer resin commonly referred to as Teflon from the DuPont Corporation. A low friction material, e.g., one having a coefficient of friction equal or less than about 0.02, may be applied to any portion of the centralizer as desired. In an embodiment, a low friction material is applied to a centralizer, e.g., the exterior surface of the bows, to create a coating with a thickness suited to the environmental conditions experienced by the centralizer during centralization (e.g., installation) of a tubular in a borehole. In an embodiment, the low friction material is applied to the centralizer about 2 microns thick. A low friction material, e.g., on the outer surface of the bows, may allow a lower starting (static) and running (dynamic) force as compared to a centralizer without a lower friction material on a surface thereof (e.g., on the bows). For example, a centralizer with a low friction material applied (e.g., on the bows) may allow bows of a relatively rigid material (e.g., a material having have a yield strength of at least about 200,000 psi) to be utilized where without such a low friction material, e.g., material having a coefficient of friction equal or less than about 0.02, on the bows, the starting and/or running force would exceed the capabilities of the machinery to run the tubular and centralizer(s) assembly into the hole (e.g., a drilling rig). A plurality of centralizers (e.g., 10s or even 100s) may be used on a tubular (e.g., tubular string) and the starting and/or running force would thus increase based on the multiple contact areas with the borehole and/or restrictions. This is sometimes referred to as the "drag force". In an embodiment, the drag force generated by the bows of the centralizer (s) is less than the weight of the tubular, e.g., the weight of the tubular when disposed in drilling fluid (mud), onto which the centralizer is installed to allow insertion into the borehole.

Figure 3A:
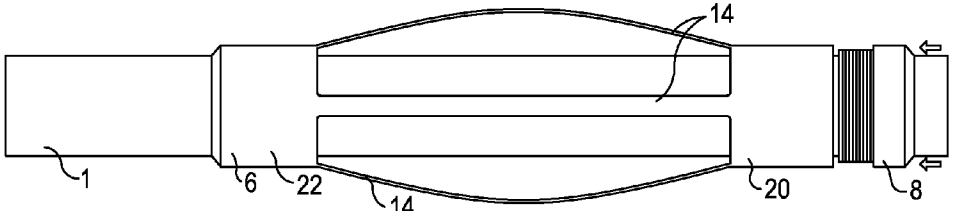
FIG. 3A illustrates a perspective view of the tubular body of the centralizer disposed onto the tubular past first and second stop collars and a retainer being disposed onto the tubular.

FIG. 3A illustrates a perspective view of the tubular body 6 of the centralizer disposed onto the tubular 1 past a first stop collar 2 and a (optional) second stop collar 4, and a retainer 8 being disposed onto the tubular 1 from an opposing direction. Illustrated retainer 8 has a bore with an inner diameter smaller than the outer diameter of the stop collars (2, 4) to block passage of the stop collar(s) therethrough, e.g., when the retainer 8 is attached to the first collar 20 of the tubular body 6. Retainer 8 may be a single piece (e.g., circumferentially continuous) or multiple pieces so as to allow lateral installation about a tubular. FIG. 3B illustrates a cross-sectional view of the tubular body 6 of the centralizer disposed onto the tubular 1 past the first stop collar 2 and second stop collar 4 and the retainer 8 being disposed onto the tubular of FIG. 3A. Depicted retainer 8 includes an outer portion having a smaller outer diameter than the remainder, with threads (optional) on the smaller outer diameter section. Similarly, threads may be formed on an inner wall of the bore of the first collar 20, e.g., to receive the threads of the retainer 8. In the depicted embodiment, a portion of the retainer 8 is disposed within the bore of the second collar 20. An entire retainer (e.g., the axial extent thereof) may be disposed within the bore of a collar of the centralizer, e.g., second collar 20. A portion or an entire retainer (e.g., the axial extent thereof) may be disposed around a collar of the centralizer, e.g., second collar 20.

Retainer 8 and/or centralizer tubular body 6 may be installed manually or via an installation machine (e.g., automatically). Although not depicted, both ends of the centralizer tubular body 6 may receive a retainer 8, e.g., each end of the tubular body 6 taking the form shown with first collar 20 and attachable retainer 8. In such an embodiment, a stop collar (2, 4) may be passed through a tubular body collar 20 and then an according retainer 8 installed on each collar to then restrict passage thereby of the stop collar (2, 4).

Figure 4A:
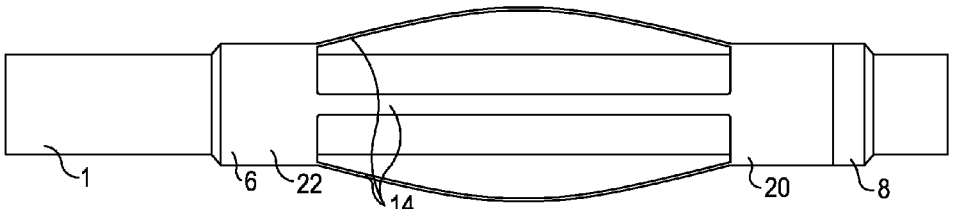
FIG. 4A illustrates a perspective view of the retainer attached to the tubular body to form a centralizer.

FIG. 4A illustrates a perspective view of the retainer 8 attached to the first collar 20 of the tubular body 6 to form a centralizer 10. FIG. 4B illustrates a cross-sectional view of the retainer 8 attached to the tubular body 6 to form the centralizer 10 of FIG. 4A. Retainer 8 may attach to the tubular body 6 of the centralizer 10 by threads as depicted. Additionally or alternatively, retainer may attach to the tubular body of the centralizer via epoxy or weld (e.g., a seam weld or a plug weld). Retainer may attach to the tubular body of the centralizer by a mechanical interaction or other attachment methods known in the attaching arts. Retainer may be removably attached to the tubular body, e.g., by threads that allow unthreading of connected components. Retainer may form a shoulder therein, e.g., on an end proximal the tubular body, to contact the stop collar(s). Stop collars (2, 4) may be axially spaced on the tubular 1 to allow the first collar 20 and second collar 22 interconnected via bow 14 (e.g., bow spring) 14 to be axially spaced so as to allow the bows 14 to fully radially deploy. For example, as depicted, the interaction between the stop collars (2, 4) and centralizer collars (20, 22) (with attached retainer 8) limits the axial movement of the centralizer 10 on the tubular 1. As depicted, the stop collars are disposed internally within the centralizer 10.

As depicted, the centralizer 10 includes a recess 26 (see FIGS. 2B and 4B), e.g., to laterally receive the stop collar to allow encirclement thereof. Recess 26 may allow a stop collar (2, 4) to be protected from (e.g., lateral) contact by the borehole (and any restrictions, etc.). In one embodiment, recess 26 protects the base 16 and/or sleeve(s) 18 of an interference fit stop collar from unwanted contact, e.g., by the borehole (and any restrictions, etc.). Such unwanted contacted may lessen the stop collar's holding capability on the tubular. As noted above, a single stop collar may be utilized without departing from the spirit of the disclosure. As a centralizer is pulled through a borehole, e.g., a restriction, by a stop collar on a tubular, the stop collar may be disposed into the recess of the centralizer.

In an embodiment, a method of manufacturing a centralizer includes forming (e.g., machining) the tubular body, bows and/or retainer. The centralizer and/or bows (e.g., an external surface thereof) may be coated with a material having a coefficient of friction equal or less than about 0.02, for example, by particle vapor deposition, pulsed laser deposition or magnetron sputtering.

In an embodiment, a tubular with a stop collar may be centralized with a centralizer (e.g., centralizer 10) according to the embodiments of this disclosure. The centralizer may be mounted on a tubular such that a stop collar(s) of the tubular is positioned between a first and second collar of the centralizer, with the stop collar(s) axially retaining the centralizer. In an embodiment, a stop collar positioned proximal to the bows and a centralizer collar (e.g., stop collar 2 contacting the shoulder 24 of centralizer collar 22 as in the Figures) allows the bows to be pulled (e.g., through a restriction) so as to urge the radial collapse of the bows, as opposed to being pushed if the stop collar was positioned distal to bows so as to urge the radial expansion of the bows. In an embodiment, a centralizer is pulled through a restriction in the borehole by the stop collar contacting a shoulder (e.g., circumferentially extending) of the first collar or the second collar (e.g., the collar closest to the restriction upon entry) and collapsing the plurality of collapsible bows to allow passage through the restriction. Being able to "pull" a centralizer may aid in the reciprocation (e.g., movement into and out of the borehole) of the tubular, e.g., to traverse a restriction and/or evenly distribute cement (if there is a liquid cement slurry present) around the tubular.

In an embodiment, a centralizer may be rotated relative to the tubular (e.g., relative to a stop collar thereon). A tubular may be rotated while running into and/or out of a borehole to aid in the axial movement of the tubular, e.g., when traversing in the borehole dog legs, ledges, bridges, windows in an outer tubular, etc. A tubular may be rotated while the centralizer (e.g., the bows thereof) remains geostationary, e.g., when cement has been displaced into the annulus between the tubular and a borehole. For example, rotation may be utilized to facilitate an even cement distribution around the tubular. A centralizer (e.g., the components rotatable relative to the tubular) may be formed of a material having a yield strength of at least about 200,000 psi, for example, because such a material may provide a high resistance to abrasion and/or galling.

In an embodiment, the use of (e.g., bi-center) drill bits and/or under-reamers create an open hole (e.g., no external tubular) that is larger than the section of borehole above. A centralizer used in an enlarged open hole section may be selected (e.g., formed of a material) to offer a sufficient restoring force to properly centralize the tubular in the open hole, e.g., in non-vertically oriented borehole, such as a horizontal borehole section. High restoring and low starting and running forces have been found to be generally incompatible with conventional material (e.g., steel) centralizers as the bow material tends to plastically yield (i.e., fail) when subjected to high stress when entering and passing through a restriction (e.g., a close tolerance application). Once the bow material has exceeded its limit of elasticity, it no longer has its original spring properties and, as a result, an undesirably low restoring force (e.g., especially in an enlarged hole) may be expected with conventional material centralizers.

In an embodiment, a centralizer according to the disclosure herein may be used with a stop collar (such as an interference fit stop collar) to position the centralizer anywhere on the tubular, e.g., along the length of the tubular. A plurality of centralizers per tubular (e.g., tubular joint) are sometimes used, e.g., when an optimum centralization of the tubular shoe track is desired. In an embodiment, a centralizer according to the disclosure herein may be used with a stop collar (such as an interference fit stop collar) to allow installation of the centralizer(s) and stop collar(s) in a remote location (e.g., pipe yard or drilling rig site) instead of an assembly plant, thus resulting in time and costs savings. In an embodiment, a centralizer(s) according to the disclosure herein may be used with a stop collar(s) (such as an interference fit stop collar) so as to keep the length of individual tubulars (e.g., joints) unchanged to allow the use of conventional semi-trailers and tubular handling equipment, as compared to adding axial extending subs which may not fit on conventional semi-trailers or drilling rigs.

In an embodiment, a centralizer according to the disclosure herein may be used with a stop collar (such as an interference fit stop collar) to allow the tubular and centralizer assembly to traverse a restriction (e.g., exit windows in an external tubular and crooked holes) without diminishing the centralizer's performance (e.g., providing a desired stand-off) after running in the borehole. For example, such an assembly may include a resistance to tension and compression when the string needs to be rotated and/or moved axially, e.g., to unstick the tubular from the borehole.

A centralizer according to the disclosure herein may be used with a stop collar (such as an interference fit stop collar) without negatively affecting the tubular string the stop collar and centralizer are disposed on. For example, it may be desired to not affect the axial stiffness (e.g., flexibility) of a tubular (e.g., casing string) so as not to negatively affect the running of the tubular into and/or out of the borehole. In an embodiment, a centralizer according to the disclosure herein may be used with a stop collar (such as an interference fit stop collar) without additional subs or other components that add axial length to the tubular as the length of a tubular in the oilfield is generally standard, e.g., about 30 ft. Adding length to a tubular (e.g., a joint) may be undesirable, such as resulting in additional time needed to make up or break out that tubular assembly (e.g., plurality of joints threaded together). In an embodiment, a centralizer according to the disclosure herein may be used with a stop collar (such as an interference fit stop collar) without negatively affecting the mechanical and pressure integrity of the tubular (e.g., tubular string). In an embodiment, a centralizer according to the disclosure herein may be used with a stop collar (such as an interference fit stop collar) without reducing the wall thickness of the tubular, for example, a reduced wall thickness of a tubular created by a groove, slot or other void machined into that tubular wall may negatively affect the mechanical and/or pressure integrity of the tubular, e.g., the reduced wall thickness may form a stress concentrator.

Figure 5A:
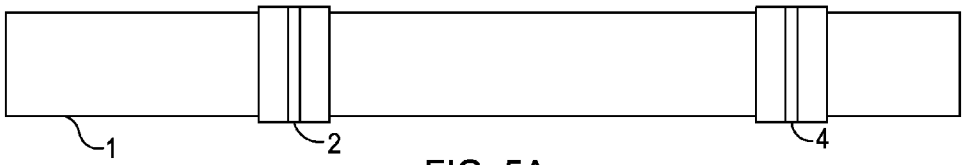
FIG. 5A illustrates a perspective view of a tubular with two stop collars attached thereto.
Figure 5B:
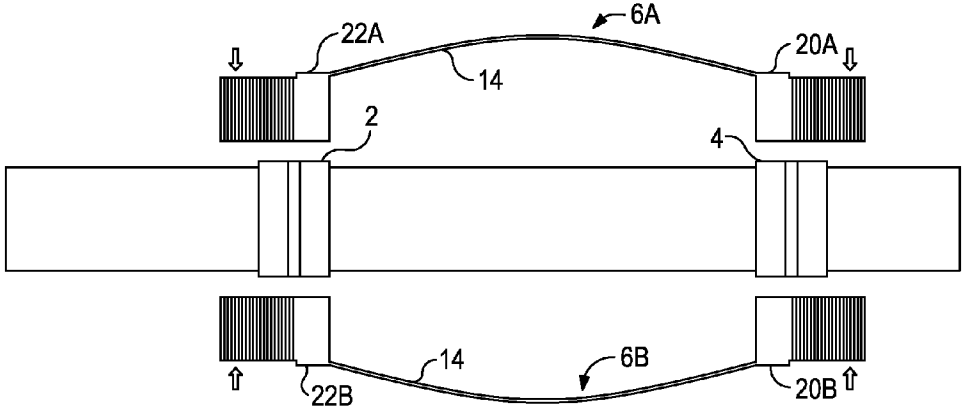
FIG. 5B illustrates a perspective view of a split tubular body of a centralizer being disposed adjacent the tubular and stop collars.

FIG. 5A illustrates a perspective view of a tubular 1 with two stop collars (2, 4) attached thereto. As above, stop collar (s) may be an interference fit stop collar(s). FIG. 5B illustrates a perspective view of a split tubular body (6A, 6B) of a centralizer 10 being disposed adjacent the tubular 1 and stop collars (2, 4). Although two stop collars are depicted, only one stop collar may be utilized without departing from the spirit of the disclosure. Split tubular body may include a single longitudinal split, e.g., where the tubular may be laterally received into the bore defined by the split tubular body, e.g., an elastically spread apart split tubular body. Split tubular body may include two or more discrete sections, e.g., split into equal axial sections as illustrated. Split tubular sections may include identical or unidentical sections. Split tubular body comprises a plurality of collapsible bows 14, e.g., as discussed above. Split tubular body sections (6A, 6B) depicted include a semi-circle section (22A, 20A; 22B. 20B) on each end, e.g., cumulatively defining a collar (e.g., ring). Circumferential length of end sections of split tubular body may be larger than the width of the bows 14. As depicted, first collar is cumulatively formed by the end collar sections (e.g., 22A and 22B form a first collar of a centralizer and 20A and 20B form a second collar of a centralizer), e.g., by laterally abutting the collar portions of the split tubular body sections.

Figure 5C:
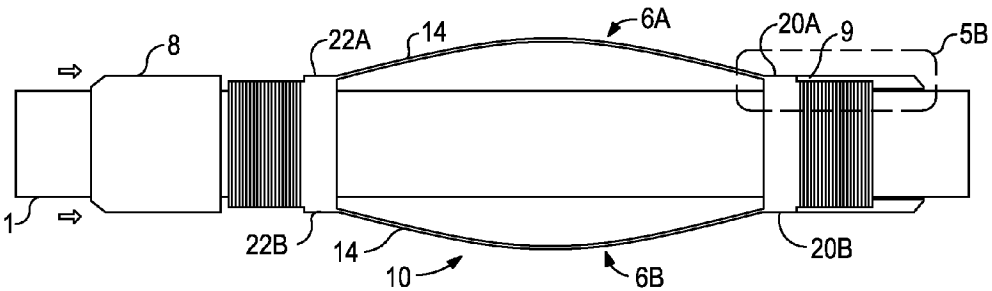
FIG. 5C illustrates a schematic view of the split tubular body of a centralizer disposed onto the tubular and stop collars.

FIG. 5C illustrates a schematic view of the split tubular body (6A and 6B) of a centralizer 10 disposed on the tubular 1 and stop collars (2. 4). Left portion of FIG. 5C illustrates a retainer 8, e.g., a circumferentially unitary retainer having a bore therethrough, being axially disposed onto the tubular 1. Depicted retainer includes an internally threaded portion. Depicted centralizer collar (e.g., 22A and 22B) cumulatively formed by the end collar sections includes an externally thread portion. A retainer may attach to the split tubular body of the centralizer 10, e.g., to a centralizer collar, by threads as depicted. Additionally or alternatively, retainer may attach to the split tubular body of the centralizer via epoxy or weld (e.g., seam weld or plug weld). Retainer may attach to the split tubular body of the centralizer by a mechanical interaction or other attachment methods known in the attaching arts. Retainer may be removably attached to the split tubular body, e.g., by threads that allow unthreading of connected components. Retainer may form a shoulder therein, e.g., on an end distal the bows, to contact the stop collar(s).

Figure 5D:
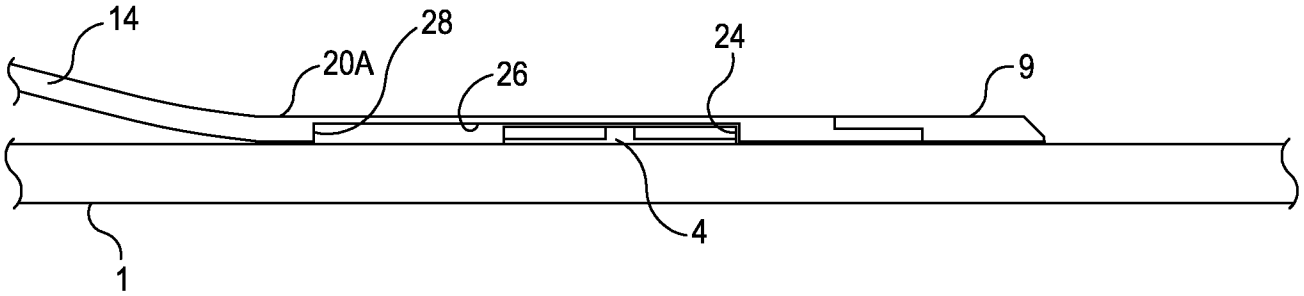
FIG. 5D illustrates an enlarged cross-sectional schematic view of the encircled portion of FIG. 5C.

Right portion of FIG. 5C illustrates a retainer 9, e.g., a circumferentially unitary retainer having a bore therethrough, attached to split tubular body, e.g., attached to the centralizer collar cumulatively formed by the end collar sections (20A, 20B). FIG. 5D illustrates an enlarged cross-sectional schematic view of the encircled portion of FIG. 5C. Although only one portion is shown, one of ordinary skill in the art will understand that the cross-sectional schematic view may extend fully about the tubular. Retainer, e.g., 8 or 9, may include a thinner portion for being received by a portion of the split tubular body, e.g., centralizer collar (20A, 20B). Depicted stop collar 4 is received into a recess 26 (e.g., a circumferentially continuous recess) cumulatively formed by a centralizer collar, e.g., (20A, 20B). Recess 26 in FIG. 5D includes a first shoulder 28 and a second shoulder 24 therein. Recess 26 is axially longer than the stop collar 4 to allow axial movement of the split tubular body relative to the stop collar 4, e.g., to allow collapse of the bows. Depicted centralizer 10 includes a recess on each end thereof receiving a stop collar to allow the collars to move apart axially relative to the stop collars to allow the bows to fully collapse. As above, bows may be unitary with a split tubular body section or a discrete bows connected to a split tubular body section(s). In an embodiment, the centralizer collar sections are laterally disposed onto a tubular having stop collars such that a stop collar recess is received by a corresponding stop collar with a retainer then attached to the collar sections to retain the collar sections on the tubular, e.g., to retain the stop collar within a centralizer recess.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A centralizer to center a tubular in a borehole, comprising:

a first collar having an inner diameter larger than an outer diameter of a stop collar of the tubular to allow passage of the stop collar therethrough;

a retainer having a bore with an inner diameter smaller than the outer diameter of the stop collar to block passage of the stop collar therethrough when the retainer is attached to the first collar;

a second collar having an inner diameter smaller than the outer diameter of the stop collar; and a plurality of collapsible bows connecting the first collar and the second collar, wherein the first collar is configured to slide over and past the stop collar, and the second collar is prevented from sliding over the stop collar, such that, when the centralizer is disposed on the tubular, the stop collar is positioned axially between axial extents of the first collar and the second collar.

2. The centralizer of claim 1, wherein the plurality of collapsible bows have a yield strength of at least about 200,000 psi.

3. The centralizer of claim 2, wherein the plurality of collapsible bows comprise a beryllium copper alloy.

4. The centralizer of claim 1, wherein the retainer is removably attached to the first collar.

5. The centralizer of claim 1, wherein the retainer is attached to the first collar with at least one of an epoxy, a weldment, or a mechanical interaction.

6. The centralizer of claim 1, wherein at least one of the first collar or the second collar comprises a recess therein to receive the stop collar, such that the at least one of the first collar or the second collar encircles the stop collar.

7. The centralizer of claim 1, wherein the stop collar is an interference fit stop collar.

8. The centralizer of claim 1, wherein a maximum radial thickness of the centralizer when the plurality of collapsible bows is fully collapsed is equal to or less than 3/16".

9. The centralizer of claim 1, wherein the centralizer is rotatable relative to the tubular.

10. The centralizer of claim 1, wherein the retainer, the second collar, or both are configured to engage the stop collar and limit axial translation of the centralizer with respect to the tubular.

11. The centralizer of claim 1, wherein the first collar is configured to slide past the stop collar and out of engagement therewith.

12. A centralizer to center a tubular in a borehole, comprising:

a first collar having an inner diameter larger than an outer diameter of a stop collar of the tubular to allow passage of the stop collar therethrough;

a retainer having a bore with an inner diameter smaller than the outer diameter of the stop collar to block passage of the stop collar therethrough when the retainer is attached to the first collar;

a second collar having an inner diameter smaller than the outer diameter of the stop collar; and a plurality of collapsible bows connecting the first collar and the second collar, wherein an outer surface of the plurality of collapsible bows comprises a material having a coefficient of friction equal or less than about 0.02.

13. A method of assembling a centralizer for centralizing a tubular in a borehole comprising:

sliding a first collar of the centralizer onto the tubular and over and past a stop collar of the tubular, wherein the first collar comprises an inner diameter larger than an outer diameter of the stop collar of the tubular to allow passage of the stop collar therethrough;

sliding a second collar of the centralizer onto the tubular, wherein the second collar comprises an inner diameter smaller than the outer diameter of the stop collar, and the second collar is prevented from sliding over the stop collar such that, when the centralizer is disposed on the tubular, the stop collar is positioned axially between axial extents of the first collar and the second collar, and wherein a plurality of collapsible bows connect the first collar and the second collar; and attaching a retainer to the first collar to block passage of the stop collar therethrough, the retainer having a bore with an inner diameter smaller than the outer diameter of the stop collar.

14. The method of claim 13, wherein the attaching the retainer to the first collar comprises removably attaching the retainer to the first collar.

15. The method of claim 13, wherein the plurality of collapsible bows have a yield strength of at least about 200,000 psi.

16. The method of claim 13 or 15, wherein an outer surface of the plurality of collapsible bows comprises a material having a coefficient of friction equal or less than about 0.02.

17. The method of claim 13, wherein a maximum radial thickness of the centralizer when the plurality of collapsible bows is fully collapsed is equal to or less than 3/16".

18. A centralizer to center a tubular in a borehole comprising:

a split tubular body forming a first collar and a second collar connected by a plurality of collapsible bows; and a retainer attached to the split tubular body to retain the split tubular body on the tubular, at least one of the retainer, the first collar, or the second collar providing a recess therein configured to receive a stop collar of the tubular so as to limit an axial translation of the centralizer by engagement with the stop collar, wherein the split tubular body comprises a first body section and a second body section, the first body section being disposed on a first angular interval of the tubular, and the second body section being disposed on a second angular interval of the tubular, and wherein the stop collar is axially between at least a portion of the first collar and at least a portion of the second collar.

19. The centralizer of claim 18, wherein the split tubular body is split along a longitudinal axis thereof.

20. The centralizer of claim 18, wherein the stop collar is axially movable in the recess.

21. The centralizer of claim 18, wherein the plurality of collapsible bows have a yield strength of at least about 200,000 psi.

22. The centralizer of claim 21, wherein the plurality of collapsible bows comprise a beryllium copper alloy.

23. The centralizer of claim 18, wherein an outer surface of the plurality of collapsible bows comprises a material having a coefficient of friction equal or less than about 0.02.

24. The centralizer of claim 18, wherein the retainer is removably attached to the split tubular body.

25. The centralizer of claim 18, wherein the retainer is attached to the split tubular body with at least one of an epoxy, a weldment and a mechanical interaction.

26. The centralizer of claim 18, wherein the stop collar is an interference fit stop collar.

27. The centralizer of claim 18, wherein a maximum radial thickness of the centralizer when the plurality of collapsible bows is fully collapsed is equal to or less than 3/16".

28. The centralizer of claim 18, wherein the centralizer is rotatable relative to the tubular.

29. A method of assembling a centralizer for centralizing a tubular in a borehole comprising:

disposing a split tubular body forming a first collar and a second collar connected by a plurality of collapsible bows adjacent a stop collar of the tubular;

attaching a retainer to the split tubular body to retain the split tubular body on the tubular; and receiving the stop collar into a recess provided by at least one of the retainer, the first collar or the second collar, wherein an axial translation of the centralizer with respect to the tubular is limited by engagement between the centralizer and the stop collar, wherein disposing the split tubular body adjacent the stop collar of the tubular comprises:

disposing a first body section of the split tubular body on a first angular interval of the tubular; and disposing a second body section on a second angular interval of the tubular, wherein the stop collar is axially between at least a portion of the first collar and at least a portion of the second collar.

30. The method of claim 29, wherein attaching the retainer to the split tubular body comprises removably attaching the retainer to the split tubular body.

31. The method of claim 29, wherein the plurality of collapsible bows have a yield strength of at least about 200,000 psi.

32. The method of claim 29, wherein an outer surface of the plurality of collapsible bows comprises a material having a coefficient of friction equal or less than about 0.02.

33. The method of claim 29, wherein a maximum radial thickness of the centralizer when the plurality of collapsible bows is fully collapsed is equal to or less than 3/16".

34. The method of claim 29, wherein attaching the retainer to the split tubular body comprises connecting the first and second body portions together using the retainer after disposing the first and second body portions on the tubular.

35. The method of claim 34, further comprising attaching a second retainer to the second collar of the split tubular body, wherein attaching the retainer to the split tubular body comprises attaching the retainer to the first collar of the split tubular body, and wherein the first and second body portions are not connected together except by the retainer and the second retainer.

36. The method of claim 34, wherein attaching the retainer comprises receiving the retainer around the split tubular body.

37. A method of centralizing a tubular in a borehole with a centralizer comprising:

disposing the tubular comprising a stop collar into the borehole, wherein the centralizer comprises a split tubular body forming a first collar and a second collar connected by a plurality of collapsible bows that is retained on the tubular by a retainer and wherein the stop collar is received into a recess provided by at least one of the retainer, the first collar and the second collar; and pulling the centralizer into a restriction in the borehole by the stop collar contacting the centralizer and collapsing the plurality of collapsible bows, wherein a maximum radial thickness of the centralizer when the plurality of collapsible bows is fully collapsed is equal to or less than 3/16".

38. The method of claim 37, wherein pulling comprises pulling the centralizer completely through the restriction in the borehole to allow a plurality of collapsed bows to elastically return to a non-collapsed configuration, wherein the plurality of collapsible bows have a yield strength of at least about 200,000 psi.

39. The method of claim 37 or 38, wherein an outer surface of the plurality of collapsible bows comprises a material having a coefficient of friction equal or less than about 0.02.

40. The method of claim 37, further comprising rotating the tubular relative to the centralizer.

* * * * *